United States Patent [19]

Weichsler

[11] Patent Number: 4,635,592

[45] Date of Patent: Jan. 13, 1987

[54] VALVE CONTROL FOR AN INTERNAL COMBUSTION ENGINE

[75] Inventor: Hermann Weichsler, Klagenfurt, Austria

[73] Assignee: Bombardier-Rotax Gesellschaft m.b.H., Gunskirchen, Austria

[21] Appl. No.: 709,761

[22] Filed: Mar. 7, 1985

[30] Foreign Application Priority Data

Mar. 14, 1984 [AT] Austria ..... 843/84

[51] Int. Cl.[4] ..... F01L 1/24; F01L 1/26

[52] U.S. Cl. ..... 123/90.18; 123/90.27; 123/90.6; 123/90.23; 123/308; 123/315

[58] Field of Search ..... 123/90.27, 90.18, 90.55, 123/308, 90.4, 90.6, 90.22, 90.23, 315

[56] References Cited

U.S. PATENT DOCUMENTS

| | | | |
|---|---|---|---|
| 3,481,314 | 12/1969 | Crenn | 123/90.18 |
| 3,638,624 | 2/1972 | O'Grady | 123/90.18 |
| 3,730,150 | 5/1973 | Codner, Jr. | 123/90.18 |
| 4,352,344 | 10/1982 | Soyana et al. | 123/90.18 |

FOREIGN PATENT DOCUMENTS

| | | | |
|---|---|---|---|
| 953672 | 12/1956 | Fed. Rep. of Germany . | |
| 2300827 | 7/1974 | Fed. Rep. of Germany | 123/90.18 |
| 8415 | 1/1978 | Japan | 123/90.55 |
| 96310 | 7/1980 | Japan | 123/90.18 |
| 210126 | 12/1982 | Japan | 123/90.27 |
| 3332699 | 3/1984 | Japan | 123/90.27 |
| 226442 | 12/1924 | United Kingdom . | |

*Primary Examiner*—Ira S. Lazarus

*Attorney, Agent, or Firm*—Kurt Kelman

[57] ABSTRACT

In an internal combustion engine with a cylinder (1), the cylinder head (2) has four valves (3, 4) inclined towards each other and arranged to be radially aligned with respect to the combustion chamber, pairs of the valves being operable by a common camshaft (6) by means of conical cams (7). To make it possible to use such a valve control for high rotational speeds, too, bucket type tappets (8) are displaceably mounted between the radially aligned valves (3, 4) and the conical cams (7) in the cylinder head (2).

8 Claims, 4 Drawing Figures

VALVE CONTROL FOR AN INTERNAL COMBUSTION ENGINE

Figure 1:
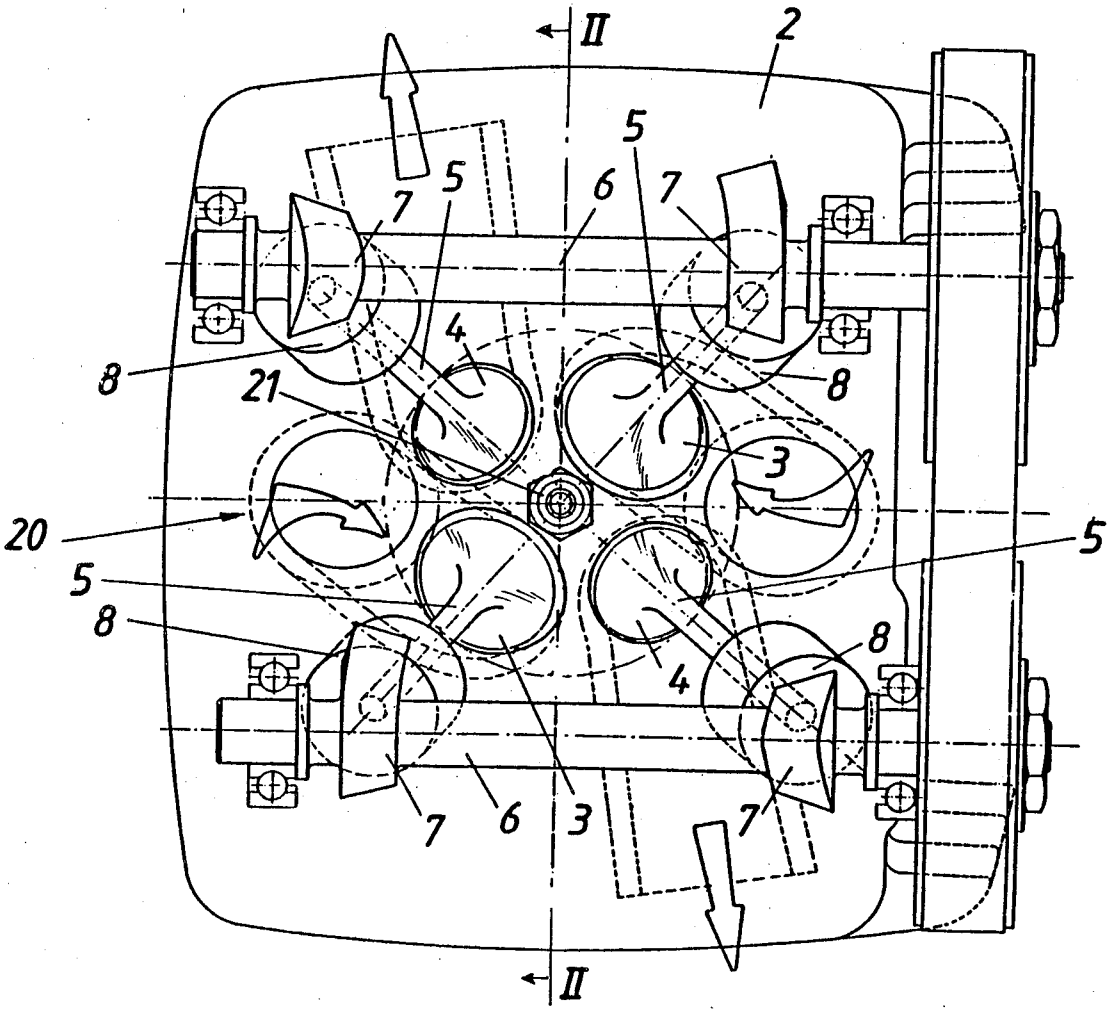

The invention relates to a valve control for an internal combustion engine with at least one cylinder whose cylinder head has at least one pair of valves inclined towards each other and arranged to be radially aligned with respect to the combustion chamber, the valves being operable by a common camshaft by means of conical cams.

To obtain good combustion, hemispherical combustion chambers are desirable in internal combustion engines, which require valve arrangements radially aligned with respect to the combustion chamber. In such an arrangement, a particularly advantageous gas exchange is obtained with a favorable utilization of the combustion chamber by providing two inlet and two outlet valves per cylinder, the valves having the same function being disposed diametrically opposed to each other with repect to the axis of the cylinder. Because of the radial alignment of the valves, subtending camshafts are used primarily for operating the valves to actuate the lifting of the valves by push-rods and rocker arms since the transmission of the lifting stroke from conventional cams of superposed camshafts to the valves of such a valve arrangement is possible only by complicated drag and toggle levers. Despite the use of subtending camshafts, a suitable valve control cannot be assured for fast-running internal combustion engines because the masses to be moved do not enable accurate valve control times to be maintained. Because the valves have a relatively low flutter limit, it is not possible to attain a high rotational speed of the engine.

To avoid a complicated drive connection between the camshaft and the valves for valves which are inclined towards each other, it is known (British Pat. No. 226,442) to form the cams conically and to let them act directly on the spring-supported discs of the valves. However, this construction has the disadvantage that the transverse forces transmitted from the conical cams to the spring-supported discs must be absorbed by the valve guide, which causes the valve guides to be worn prematurely. Furthermore, since a relative displacement of the cams takes place with respect to the spring-supported discs during the lifting stroke in the direction of the line of contact between the cams and the spring-supported discs, the spring-supported discs are subjected to a torque, which excludes the use of such a valve control for valves of a relatively large angle of inclination wherefore this known construction is useless for valves which are radially aligned with respect to the combustion chamber.

To reduce the length of an in-line motor, it is known (German Pat. No. 953,672) to incline the successively arranged valves alternately in opposite directions and to actuate them by means of a common camshaft with conical cams, the lifting of the cams being transmitted to the valve shaft by respective drag levers to avoid the transmission of transverse forces to the valve shaft. This known construction is expensive because of the provision of drag levers between the conical cams and the valves, the problem arising to support the drag levers so that the generated transverse forces can be absorbed without the drag lever bearing being prematurely worn. In addition, the spacing of the valves from each other is limited in this known construction because of the desired reduction of the length of the structure so that a radial alignment of the valves with respect to the combustion chamber is not possible.

It is, therefore, the object of the invention to avoid these shortcomings and to improve a valve control of the initially described type so that its advantages can be utilized for fast-running internal combustion engines, too, without having to accept the disadvantages encountered in the prior art.

The invention accomplishes this object with bucket type tappets displaceably mounted in the cylinder head between the radially aligned valves and the conically shaped cams.

The provision of bucket type tappets between the conically shaped cams and the valves first of all enables the additional mass moved by the cam drive to be relatively small so that the attainable motor speed will not be reduced in this respect. In addition, the bucket type tappet, which is arranged coaxially with the valve stem, may be guided in a bore of the cylinder head which accommodates the valve spring so that the transverse forces transmitted from the conical cams to the bucket type tappet may be absorbed simply by the cylinder head without subjecting the valves to any load. Because of the relatively large diameter of the guide bore for the bucket type tappets, the additional load on the tappet guide by the generated transverse forces remains within permissible limits, the space requirements for the guide of the bucket tappet being met advantageously by the space available in radial valve arrangements.

The possible length of the guide for bucket type tappets assures the absorption of the torque generated by the lifting of the cam by the bucket type tappet. However, these torque forces may be eliminated entirely if the conical cams, in the rotational position for the maximal lifting stroke, are bent in the lifting stroke range from a plane perpendicular to the axis towards the associated bucket type tappet so that the bucket type tappet is not eccentrically overrun even during the complete cam lifting stroke. By suitably taking into account the prevailing geometric conditions, the curvature of the cams assures in a simple manner that the bucket type tappet will always be centrally loaded, which permits a torque-free mounting of the bucket type tappets even if the angle of inclination of the individual valves is relatively large.

If according to a further embodiment of the invention, the conical cams are axially displaceable, any desired valve clearance may be adjusted in a simple manner because the distance of the control faces of the cams from the bucket type tappet is changed by an axial displacement of the conical cams. This removes the necessity to adjust the valve clearance by washer discs between the bucket type tappet and the valve shaft, for example.

A possible embodiment of axially displaceably arranging the cams consists of mounting the cams on the camshaft axially displaceably, the respective axial positions of the cams being defined, for example, by nuts of the shaft. Another possible embodiment for adjusting the valve clearance may be obtained by dividing the camshaft and that each shaft section carrying a single cam is individually axially displaceable. In this case, the sections of the camshaft are axially held in position to fix the adjusted valve clearance, which may be effected in various manners.

The arrangement of individually adjustable camshaft sections furthermore permits an independent adjustment of the valve clearance if the camshaft sections are hydraulically adjustable. In this arrangement, particularly simple construction conditions may be assured if each camshaft section is hydraulically actuated by a respective check valve to reduce the valve clearance because the axial position of each camshaft section is maintained with the closing of the check valve following an adjustment.

Finally, the transmission of the cam lifting stroke to the valve stems by means of bucket type tappets mounted displaceably in the cylinder head permits the arrangement of a flow channel for a cooling medium between the two camshafts in an arrangement of four radially arranged valves pairs of which are associated with a common camshaft with conical cams so that an advantageous cooling of the cylinder head in the range of the spark plugs is provided.

The invention is illustrated in the drawing by way of example.

Figure 2:
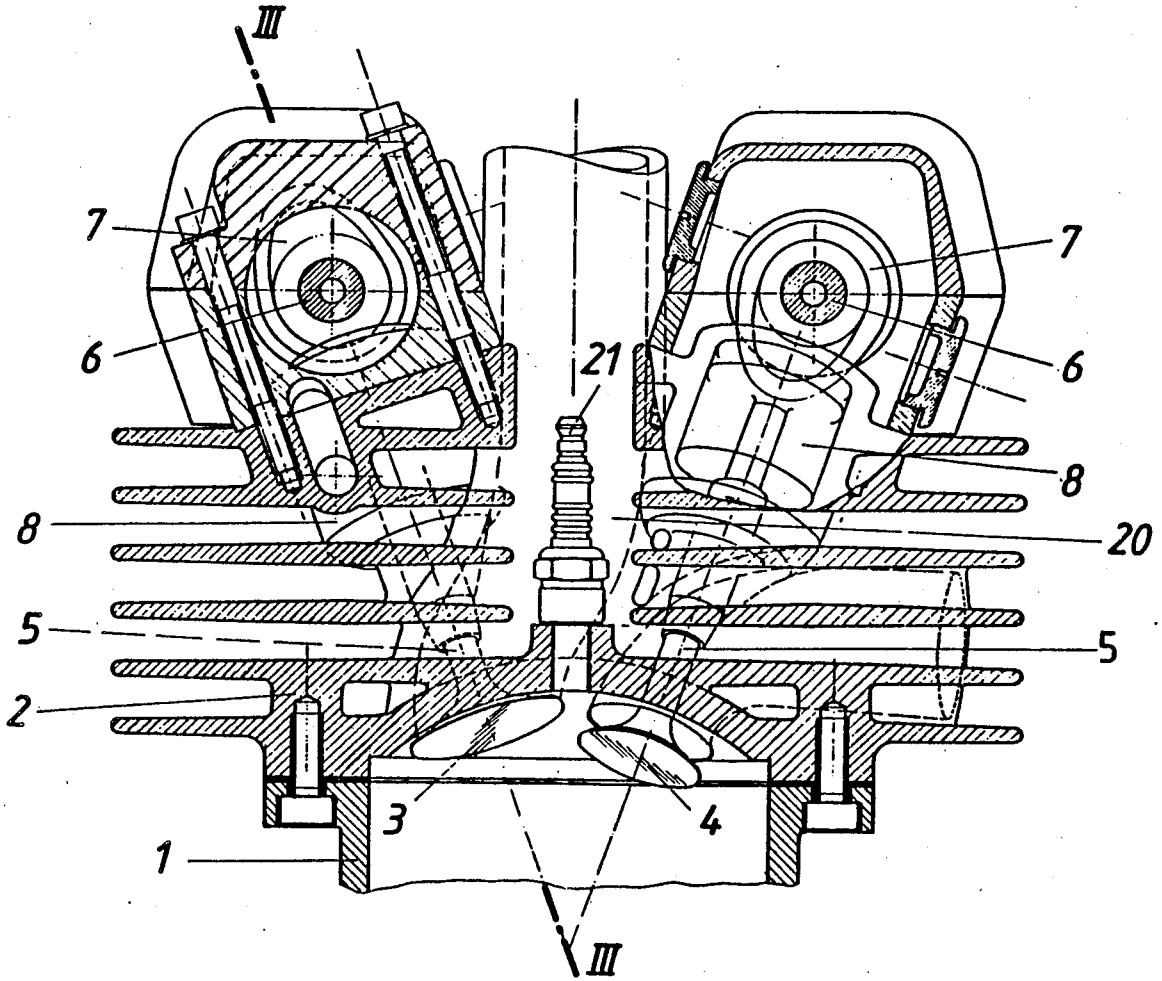
Figure 3:
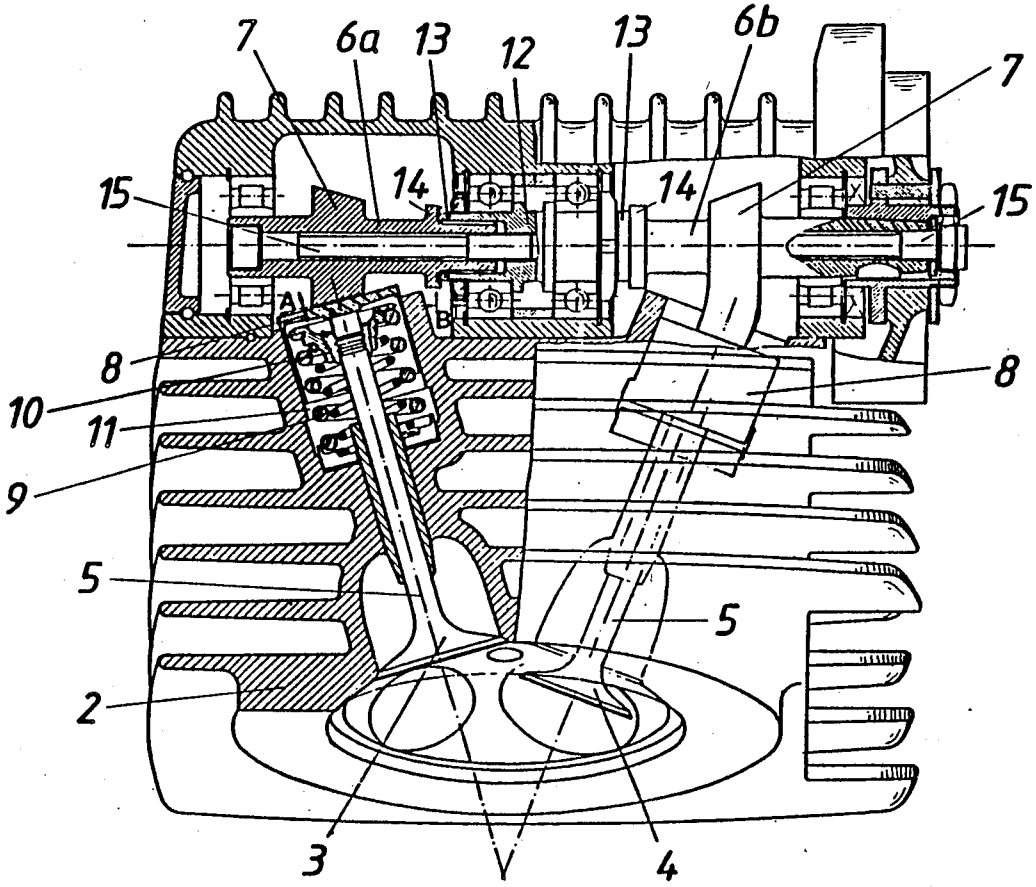
Figure 4:
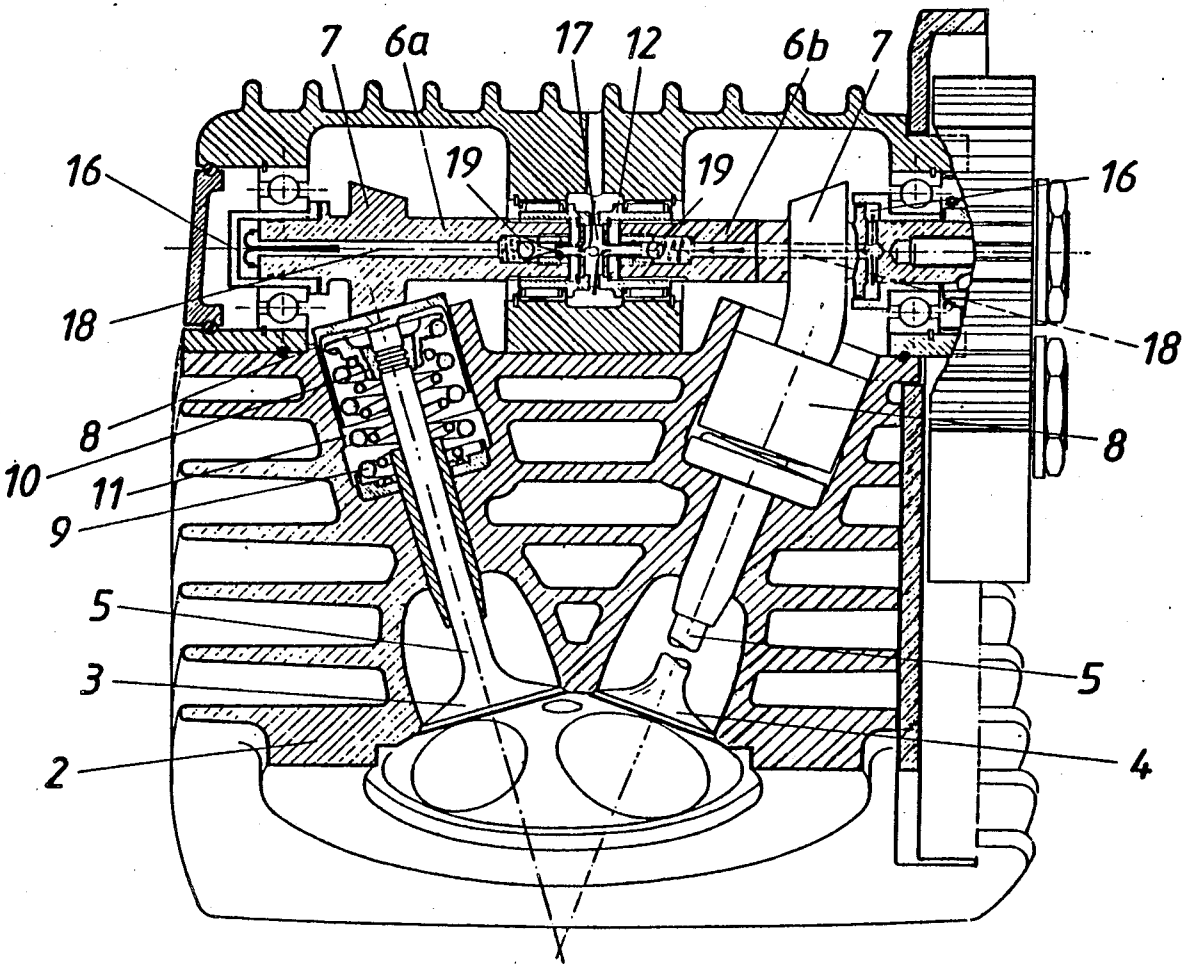

FIG. 1 shows a valve control for an internal combustion engine according to the invention in a schematic top view on a cylinder head, FIG. 2 is a section along line II—II of FIG. 1, FIG. 3 is a partial section along line III—III of FIG. 2 and FIG. 4 shows a modified construction in a section corresponding to that of FIG. 3.

The illustrated internal combustion engine comprises essentially a cylinder 1 whose cylinder head 2 has two inlet valves 3 and two outlet valves 4, the arrangement being such that the valves having the same function are positioned diametrically opposite each other with respect to the cylinder axis. In this arrangement, valves 3, 4 are radially aligned with respect of the combustion chamber which is closed by a spherical segment so that the axes of valve stems 5 intersect in the center of the sphere defining the spherical segment. A respective camshaft 6, which carries conical cams 7, is associated with each pair of valves 3, 4. The transmission of the cam lifting stroke to valve stems 5 is effected by a respective bucket type tappet 8 which is pot-shaped and coaxially surrounds valve springs 9 and valve disc 10. This bucket type tappet is displaceably guided in a bore 11 of cylinder head 2 coaxial with valve stems 5 so that the transverse forces transmitted from conical cams 7 to bucket type tappets 8 may be absorbed by the cylinder head through the wall of bore 11. Since bucket type tappet 8 loosely engages valve stem 5, a force transmission is possible only in the direction of the axis of valve stem 5 and not transversely thereto.

As may be seen particularly in FIGS. 3 and 4, conical cams 7 are bent in the rotational position for the maximal lifting stroke in the range of the lifting from a plane extending perpendicularly to the axis towards the associated bucket type tappet 8 so that cup-shaped tappet 8 cannot be overrun eccentrically by the cam during the lifting stroke. Therefore, the bucket type tappet remains centrally loaded in each lifting stroke position.

To adjust the valve clearance, camshaft 6 is divided into two shaft sections 6*a* and 6*b* according to FIG. 3, each section being individually mounted for axial displacement in the cylinder head. The two shaft sections 6*a* and 6*b* are connected for common rotation but axially displaceable by an axially fixed coupling piece 12, and a multi-groove connection is provided between shaft sections 6*a*, 6*b* and coupling piece 12. The desired valve clearance is adjusted by an axial displacement of shaft sections 6*a*, 6*b*, their position being fixed by shims 13 in the form of half-rings of a predetermined thickness inserted between coupling piece 12 and shaft collars 14 before the shaft sections are clamped together axially with coupling piece 12 with tension bolt 15. In this arrangement, the centrifugal removal of shims 13 is prevented by an axially projecting rim of shaft collar 14 which circumferentially grips the shims. Therefore, the adjustment of the valve clearance may be effected without expensive and time-consuming retrofitting work, no new adjustment of the valve control timing being required.

The construction illustrated in FIG. 4 even allows an automatic valve clearance adjustment by hydraulically actuating shaft sections 6*a*, 6*b* of camshaft 6. For this purpose, shaft sections 6*a*, 6*b* are connected to pressure cylinders 16 to which pressure oil taken from the lubricating system of the motor may be fed through channels 17 in coupling piece 12 and check valves 19 mounted in axial bores 18 of the shaft sections. If a cam 7 moves over cup-shaped tappet 8 in the range of its base circle, any clearance between the cam and the bucket type tappet is compensated because the pressure oil can flow through check valve 19 to pressure cylinder 16 and displaces the shaft section axially in the direction of a clearance reduction until the check valve is closed again by the pressure building up in pressure cylinder 16 so that the shaft section is held fixed in its axial position. Leakage losses, which occur because of a pressure reduction in pressure cylinder 16 when the cam moves over the bucket type tappet in the range of its base circle, are compensated immediately because, in this case, check valve 19 is opened again. Thus, the hydraulic actuation of shaft sections 6*a*, 6*b* in the direction of a clearance reduction between bucket type tappet 8 and cam 7 causes constant engagement of bucket type tappet 8 with cam 7, which has an advantageous effect on the quiet running and the load exerted upon the cams and bucket type tappets.

As can be seen particularly in FIG. 2, a flow channel 20 for a cooling medium may be accommodated between the two camshafts 6 and valves 3 and 4 associated with these camshafts, which provides favorable cooling conditions in the range of central spark plug 21, too, particularly in air-cooled motors.

I claim:

1. Valve control for an internal combustion engine with at least one cylinder whose cylinder head has at least one pair of valves inclined towards each other and arranged to be radially aligned with respect to the combustion chamber, the valves being operable by a common camshaft by means of conical cams, wherein the improvement comprises bucket type tappets displaceably mounted in the cylinder head between the radially aligned valves and the conically shaped cams.

2. Valve control according to claim 1, wherein the conical cams, in the rotational position for the maximal lifting stroke, are bent in the lifting stroke range from a plane perpendicular to the axis towards the associated bucket type tappet.

3. Valve control according to claim 1, wherein the conical cams are axially displaceable.

4. Valve control according to claim 3, wherein the cams are axially displaceably mounted on the camshaft.

5. Valve control according to claim 3, wherein the camshaft is divided into shaft sections each carrying a single cam and individually axially displaceable.

6. Valve control according to claim 5, wherein the shaft sections of the camshaft are hydraulically displaceable.

7. Valve control according to claim 6, wherein the hydraulic actuation of the shaft sections is effected in the direction of a reduction of the valve clearance by a respective check valve.

8. Valve control according to claim 1, wherein a flow channel for a cooling medium is provided between the two camshafts in an arrangement of four radially arranged valves each pair of which has a common camshaft with conical cams associated therewith.

* * * * *

UNITED STATES PATENT AND TRADEMARK OFFICE

CERTIFICATE OF CORRECTION

PATENT NO. : 4,635,592

DATED : January 13, 1987

INVENTOR(S) : Hermann Weichsler

It is certified that error appears in the above-identified patent and that said Letters Patent is hereby corrected as shown below:

ON THE TITLE PAGE, ITEM [73] should read

-- [73] Assignee: Hermann Weichsler, Klagenfurt, Austria --.

Signed and Sealed this

Eighth Day of December, 1987

*Attest:*

DONALD J. QUIGG

*Attesting Officer*

*Commissioner of Patents and Trademarks*